US007760060B2

(12) United States Patent
Kiuchi et al.

(10) Patent No.: US 7,760,060 B2
(45) Date of Patent: Jul. 20, 2010

(54) VEHICLE TRANSFORMER

(75) Inventors: Hiroshi Kiuchi, Tokyo (JP); Yutaka Koba, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 2 days.

(21) Appl. No.: 12/296,157

(22) PCT Filed: Jun. 15, 2007

(86) PCT No.: PCT/JP2007/062093

§ 371 (c)(1),
(2), (4) Date: Oct. 6, 2008

(87) PCT Pub. No.: WO2008/007513

PCT Pub. Date: Jan. 17, 2008

(65) Prior Publication Data

US 2009/0261933 A1 Oct. 22, 2009

(30) Foreign Application Priority Data

Jul. 10, 2006 (JP) ..... 2006-189265

(51) Int. Cl.
*H01F 27/10* (2006.01)
*H01F 27/08* (2006.01)
*H01F 27/02* (2006.01)
*H01F 27/06* (2006.01)
*H01F 27/30* (2006.01)

(52) U.S. Cl. ..... 336/58; 336/55; 336/57; 336/59; 336/60; 336/90; 336/131; 336/145; 336/179; 336/199; 336/208

(58) Field of Classification Search ..... None
See application file for complete search history.

(56) References Cited

U.S. PATENT DOCUMENTS 2,155,840 A * 4/1939 Rorden ..... 336/70

(Continued)

FOREIGN PATENT DOCUMENTS

JP 40-28093 9/1965

(Continued)

OTHER PUBLICATIONS

International Search Report for corresponding Application No. PCT/JP2007/062093, completed Sep. 5, 2007.

*Primary Examiner*—Lincoln Donovan
*Assistant Examiner*—Mangtin Lian
(74) *Attorney, Agent, or Firm*—Buchanan Ingersoll & Rooney PC

(57) ABSTRACT

In a vehicle transformer including a core 1, a winding 2, a rectangular tank 3 holding them, a cooling unit 7 for cooling a cooling medium 6 filling the tank 3, and a circulating pump 8 for forcibly circulating the cooling medium 6, a partition member 9 is provided for dividing an interior of the tank 3 into two and the partition member 9 divides a channel of the cooling medium 6 flowing within the winding 2 into a first cooling medium channel 10 and a second cooling medium channel 11, and both of the cooling medium channels 10, 11 are communicated at one end side of the tank 3 and the cooling unit 7 connected to both of the cooling medium channels 10, 11 is provided at the other end for the cooling medium 6 to flow and circulate in the first cooling medium channel 10 and the second cooling medium channel 11. Thereby, the connection between the tank and the cooling unit is simplified and a vehicle transformer reduced in size and weight is obtained.

11 Claims, 5 Drawing Sheets

U.S. PATENT DOCUMENTS

| | | | | | |
|---|---|---|---|---|---|
| 3,261,905 | A | * | 7/1966 | Allen | 174/15.1 |
| 3,416,110 | A | * | 12/1968 | Morris et al. | 336/57 |
| 3,602,858 | A | * | 8/1971 | Moore et al. | 336/60 |
| 4,350,838 | A | * | 9/1982 | Harrold | 174/15.1 |
| 5,508,672 | A | * | 4/1996 | Sokai | 336/57 |

FOREIGN PATENT DOCUMENTS

| | | | |
|---|---|---|---|
| JP | 42-5129 | | 3/1967 |
| JP | 55-034607 | U | 3/1980 |
| JP | 04-043618 | A | 2/1992 |
| JP | 09-134823 | A | 5/1997 |
| JP | 11-126718 | A | 5/1999 |
| JP | 11-176650 | A | 7/1999 |

* cited by examiner

VEHICLE TRANSFORMER

TECHNICAL FIELD

The present invention relates to a vehicle transformer mounted under a vehicle floor for use.

BACKGROUND ART

Generally, an insulating oil as a cooling medium also serving for insulation is sealed within a tank of a vehicle transformer, and the insulating oil is circulated with an oil feed pump and introduced into a cooling unit provided outside of the tank for cooling. FIG. 9 is a plan view showing a conventional vehicle transformer including such a cooling structure. FIG. 9 is a plan view seen from the floor of a vehicle 31 toward the ground side, and a thick arrow indicates the traveling direction of the vehicle. As shown in the drawing, a transformer main body 32 in which a core and a coil (not shown) are held and an insulating oil is sealed, and a cooling unit 33 for cooling the insulating oil are mounted under the floor of the vehicle 31. An outlet 32*b* of the insulating oil is provided at one end and an inlet 32*a* is provided at the other end of the transformer main body 32, and the outlet 32*b* side is connected to an inlet part of the cooling unit 33 via an oil feed pump 34 and a connecting tube 35 and the inlet 32*a* side is connected to an outlet part of the cooling unit 33 via a connecting tube 36.

The structure is arranged so that, when the oil feed pump 34 is driven, the insulating oil within the transformer main body 32 may be fed to the cooling unit 33 through the connecting tube 35 and cooled, and pass the other connecting tube 36 and return into the transformer main body 32 again. That is, a one-way channel of the insulating oil (arrows) is formed within the transformer main body 32 (see Patent Document 1, for example).

When the interior of the transformer is cooled with the insulating oil, it is desirable that the insulating oil flows as homogeneous as possible within the tank for raising the cooling efficiency. Typically, in the transformer tank having a rectangular shape, the insulating oil is circulated in the diagonal line direction within the tank. Accordingly, when the cooling unit 33 is provided on one side of the tank, for example, the inlet part of the cooling unit 33 is connected to the outlet 32*b* provided at the one side of the tank, and the outlet part of the cooling unit 33 is connected to the inlet 32*a* provided on the opposite side to the one side of the tank via the long connecting tube 36.

The vehicle transformer shown in the above Patent Document 1 is based on the concept, and the inlet 32*a* and the outlet 32*b* of the insulating oil are provided in the diagonal line direction of the transformer main body 32 and the inlet 32*a* side is connected to the outlet part of the cooling unit 33 via the long connecting tube 36 around the side surface of the transformer main body 32.

As described above, in the conventional vehicle transformer, in the connections between the transformer main body 32 and the cooling unit 33, at least one connection needs the long connecting tube 36. Accordingly, there are problems that a space for running the connecting tube 36 is necessary, and the number of parts and the insulating oil within the pipe are increased and the connection work takes a long time.

Patent Document 1: JP-A-11-176650 (page 2 and FIG. 8)

DISCLOSURE OF THE INVENTION

Problems that the Invention is to Solve

The invention has been achieved to solve the above described problems and a purpose of the invention is to obtain a vehicle transformer reduced in size and weight with simplified connections between a tank and a cooling unit by designing a channel within the tank.

Means for Solving the Problems

A vehicle transformer according to the invention is a vehicle transformer including a core, a winding wounded around a center leg of the core, a tank holding the core and the winding, a cooling unit for cooling a cooling medium filling the tank, and a circulating pump for forcibly circulating the cooling medium, and a partition member for dividing a channel of the cooling medium flowing within the winding into two is provided, and thereby, an interior of the tank is divided into two and a first cooling medium channel and a second cooling medium channel are formed, both of the cooling medium channels are communicated at one end side of the tank and the first cooling medium channel and one end of the cooling unit as well as the second cooling medium channel and the other end of the cooling unit are communicated, and the cooling medium flows through the first cooling medium channel from the cooling unit side to the one end side of the tank and circulates through the second cooling medium channel from the one end side of the tank to the cooling unit side via the communication part.

Advantages of the Invention

According to the vehicle transformer of the invention, two of the first and second cooling medium channels are formed by partitioning the interior of the tank into two with the partition member, both of the cooling medium channels are communicated at one end side and the first cooling medium channel and one end of the cooling unit as well as the second cooling medium channel and the other end of the cooling unit are communicated at the other end side, respectively, and thereby, the cooling medium is circulated through the first cooling medium channel and the second cooling medium channel. Therefore, it is not necessary to run the connecting tube for connecting the tank and the cooling unit, the long connecting tube is no longer necessary and the pipe connection work becomes easier, and reduction in size and weight of the vehicle transformer can be realized.

Other purposes, features, aspects, advantages of the invention will be clearer from the detailed description of the invention with reference to the drawings as below.

BEST MODE FOR CARRYING OUT THE INVENTION

Embodiment 1

Figure 1:
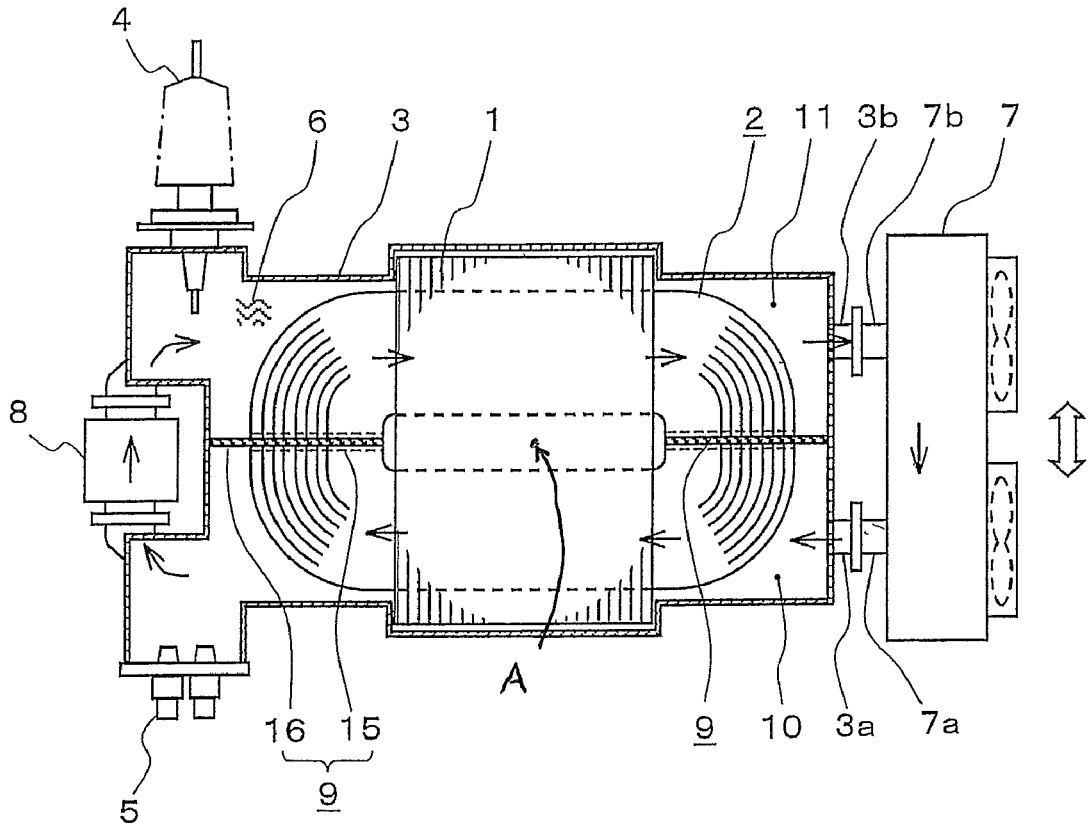
[FIG. 1] A plan sectional view showing an internal structure of a vehicle transformer according to embodiment 1 of the invention.
Figure 2:
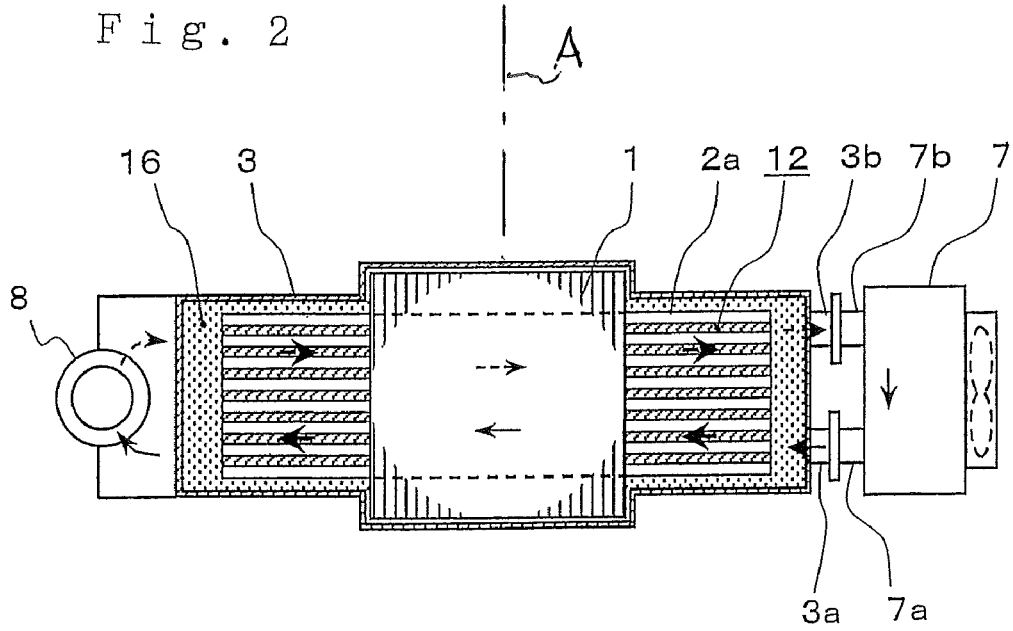
[FIG. 2] A front sectional view showing a section of the center part of FIG. 1.

FIG. 1 is a plan sectional view showing an internal structure of a vehicle transformer according to embodiment 1, and FIG. 1 is an internal structure diagram seen from the floor of a vehicle toward the ground side and a thick arrow shows the traveling direction of the vehicle. FIG. 2 is a front sectional view showing a section of the center part seen from the side of FIG. 1. The vehicle transformer is mounted under the floor of the vehicle so that the orthogonal direction to the paper surface in the front sectional view of FIG. 2 may be the traveling direction of the vehicle. As below, the configuration will be explained according to the drawings.

A core 1 is a three-leg core with laminated thin steel plates, and a high-tension and low-tension winding 2 is wounded around its center leg. The winding 2 is configured by preparing a plurality of coil plates 2*a* formed by winding a rectangular wire (or circular wire) into an oval shape about an axis A in the plan view, and alternately stacking, along the axis A, the coil plates 2*a* and insulating washers 12 that serve for insulation and securement of cooling medium channel (details will be described later).

A tank 3 holding a content including the core 1 and the winding 2 has a rectangular shape longer in the longitudinal axis direction of the winding 2 so that the shape may be fitted to the outer shape of the content, and a high-pressure bushing 4 connected to the high-tension winding is attached to one side in the longitudinal direction and a low-pressure bushing 5 connected to the low-tension winding is attached to other side. A cooling medium 6 for cooling the core 1 and the winding 2 is sealed within the tank 3. As the cooling medium 6, an insulating oil having good insulation performance, for example, a silicone oil is used. For cooling the cooling medium 6, a cooling unit 7 is provided on one side outside of the tank 3. Further, a circulating pump 8 for forcibly circulating the cooling medium 6 is provided. The cooling unit 7 in the drawing shows an air-cooling type for forcibly cooling with fans.

The vehicle transformer of embodiment 1 is characterized by the channel of the cooling medium 6 flowing within the tank 3, and its structure will be explained as below.

As shown in FIG. 1, a partition member 9 is provided to divide the interior of the tank 3 into two, and the channel of the cooling medium 6 flowing within the winding 2 is divided into a first cooling medium channel 10 and a second cooling medium channel 11 by the partition member 9. Further, both of the cooling medium channels 10, 11 are communicated using a connecting tube at one end side of the tank 3, and the circulating pump 8 is intermediately provided in the middle of the connecting tube.

The cooling medium channel is basically formed along a direction in which the cooling medium 6 passes through a core window, and the partition member 9 is provided to divide the cooling medium channel into two. Accordingly, in the case of embodiment 1, the partition member 9 is provided in the longitudinal direction of the tank 3 to vertically divide the winding 2 into two.

Further, an inlet 3*a* of the cooling medium 6 communicating with the first cooling medium channel 10 and an outlet 3*b* of the cooling medium 6 communicating with the second cooling medium channel 11 are provided on a tank wall at the other end side (the opposite side to the communication part side) of the tank 3. The cooling unit 7 is provided closely to the inlet 3*a* and the outlet 3*b* of the tank 3, and the inlet 3*a* and an outlet part 7*a* of the cooling unit 7 as well as the outlet 3*b* and an inlet part 7*a* of the cooling unit 7 are flange-connected (here, the flowing direction of the cooling medium 6 is described as the arrow direction in the drawing, however, it may be the opposite direction. In this case, it will be obvious that the inlet part and the outlet part, the inlet and the outlet are switched.

Next, the partition member 9 will be explained in more detail. It is necessary for the partition member 9 to be partitions between plural coil plates 2*a* and a partition for sealing a gap between the winding 2 and the inner wall of the tank 3. First, partitions between the coil plates 2*a* will be explained.

Figure 3:
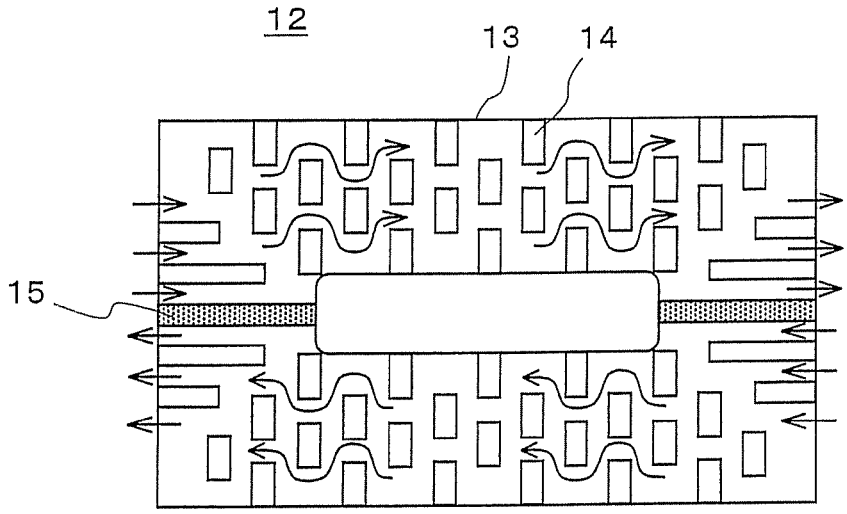
[FIG. 3] A view of an insulating washer to be inserted into coil plates of a winding in FIG. 1.

FIG. 3 is a plan view of the insulating washer 12 to be inserted into the coil plates 2*a* of the winding 2. As shown in the drawing, the insulating washer 12 is formed by bonding plural spacers 14 to an insulating plate 13. The material, dimensions, arrangement, etc. of the spacers 14 are determined so that the spacers may endure the electromagnetic mechanical force acting between the coil plates 2*a*, keep insulation, and form the channel of the cooling medium 6. Further, a partition spacer 15 (shaded part) is bonded onto the center line in the longitudinal direction of the insulating plate 13 over the entire length except the long hole at the center.

Thus formed insulating washers 12 are sandwiched between the coil plates 2*a* and all of them are laminated and completed into the winding 2, and then, the partition spacers 15 are aligned in the vertical direction and these serve as a partition member that partition the channel within the winding 2 along the longitudinal direction of the winding 2. The cooling medium 6 flows in non-linear direction along cooling medium paths formed by the spacers 14, as indicated by the arrows in the drawing.

Regarding the partition for the gap formed between the winding 2 and the inner wall of the tank 3, as shown in the front sectional view of FIG. 2, a partition plate 16 in a shape conforming to the gap is provided in a longitudinal position corresponding to the above described partition spacers 15 provided between the coil plates 2*a*. The partition plate 16 and the partition spacers 15 form the partition member 9.

The center leg of the core 1 exists at the center part of the winding 2, and the center leg serves as a partition of the center part.

Next, the operation of thus formed partition member 9 will be explained.

When the content is seen in the plan view, as shown by the arrows in FIG. 1, the channel of the cooling medium 6 within the tank 3 is divided into two major parts by the partition member 9, and two major channels of the first cooling medium channel 10 flowing from the cooling unit 7 side toward the one end side of the tank 3, i.e., the communication part side and the second cooling medium channel 11 from the communication part side toward the cooling unit 7 side.

With activation of the circulating pump 8, the cooling medium 6 flows through the first cooling medium channel 10 to the left in the drawing in a direction transversely of the axis A and absorbs the heat of one half of the winding 2 in the process of passing through the insulating washers 12 between the coil plates 2*a*, and the cooling medium 6 reaching the left end flows into the second cooling medium channel 11 via the communication part, flows to the right in the drawing in a direction transversely of the axis A while absorbing the heat of the other half of the winding 2 and rising in temperature, and is sent to the cooling unit 7 at a high temperature, cooled by the air blow with the fans in the cooling unit 7, and sent to the first cooling medium channel 10 again. In this manner, the cooling medium 6 circulates to be reciprocated in each half of the winding 2 partitioned by the partition member 9, and the content of the transformer is cooled.

The circulating pump 8 may be provided not only at the communication part of both cooling medium channels 10, 11 but also provided at the cooling unit 7, however, in this case, the dimension in the longitudinal direction may be slightly larger.

As described above, according to embodiment 1, two of the first and second cooling medium channels are formed by partitioning the interior of the tank into two with the partition member, both of the cooling medium channels are communicated at one end side and the first cooling medium channel and one end of the cooling unit as well as the second cooling medium channel and the other end of the cooling unit are communicated at the other end side, respectively, and thereby, the cooling medium is circulated through the first cooling medium channel and the second cooling medium channel. Therefore, the long connecting tube for connecting the tank and the cooling unit is no longer necessary and the cost can be reduced and the pipe connection work becomes easier, and further, reduction in size and weight of the vehicle transformer can be realized.

Further, the partition member is inserted to divide the winding into two in the vertical direction, and thereby, the partition member can easily be formed by utilizing the insulating washers inserted between the coil plates of the winding and the above advantage can be obtained.

Furthermore, the circulating pump is provided at the communication part where both cooling medium channels are communicated, and thereby, the circulating pump can be provided by effectively utilizing the distorted part of the tank of the bushing mounting part in the tank longitudinal direction and the dimension in the longitudinal direction can be made smaller compared to the case where the circulating pump is provided at the cooling unit side.

Embodiment 2

Figure 4:
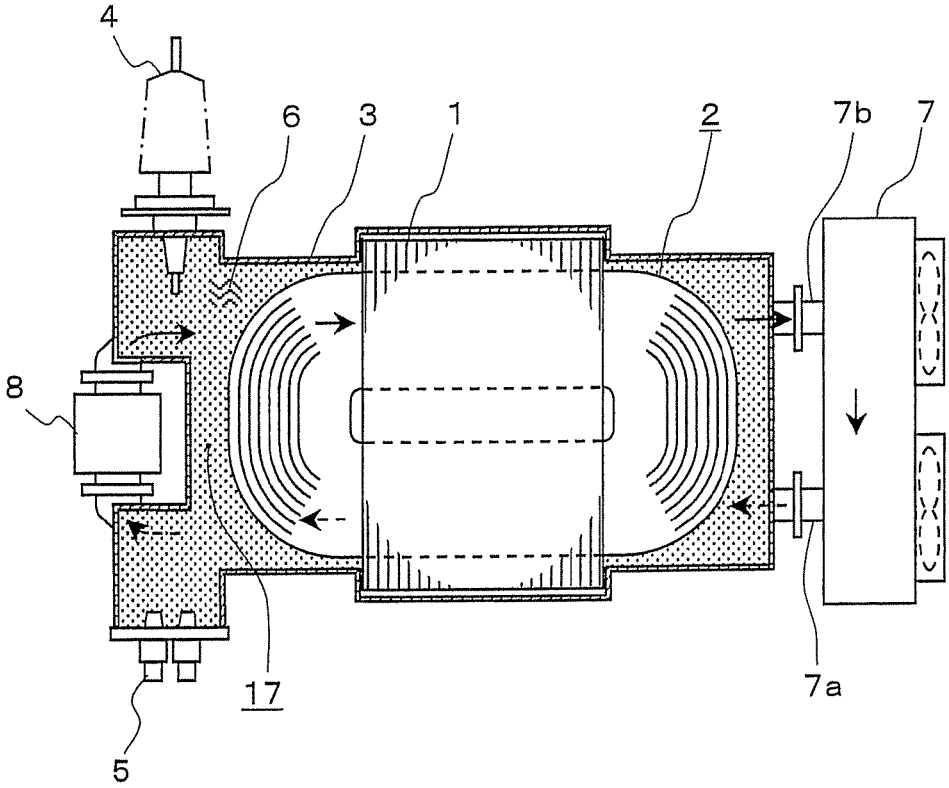
[FIG. 4] A plan sectional view showing an internal structure of a vehicle transformer according to embodiment 2.
Figure 5:
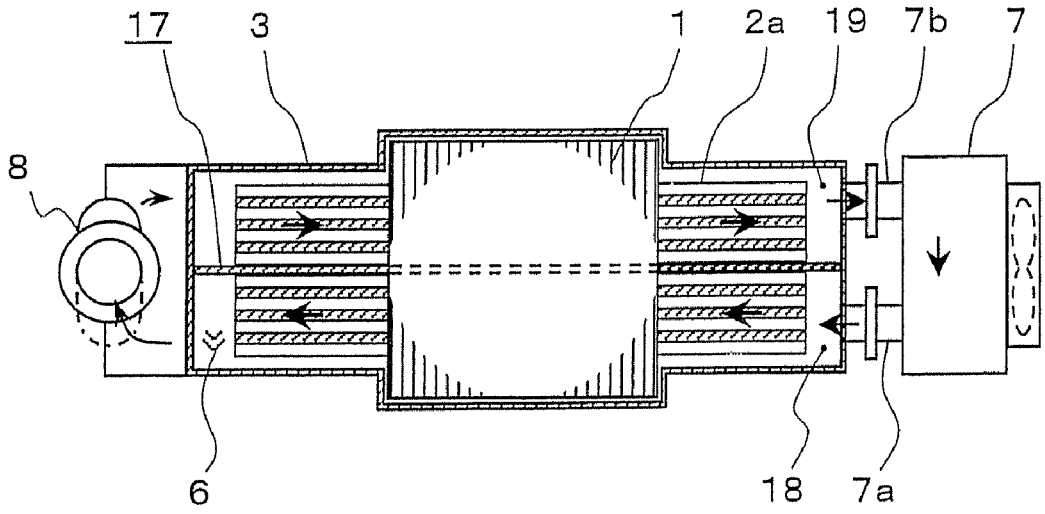
[FIG. 5] A front sectional view showing a section of the center part of FIG. 4.

FIG. 4 is a plan sectional view showing an internal structure of a vehicle transformer according to embodiment 2, and FIG. 5 is a front sectional view showing a section of the center part of FIG. 4.

The vehicle transformer of embodiment 2 is basically equal to the vehicle transformer of embodiment 1 except that the insertion direction of the partition member is different, and the same signs are assigned to the equal parts and the description thereof will be omitted. The description will be made centering on the difference.

As shown in FIGS. 4, 5, a partition member 17 of embodiment 2 is inserted in parallel to the coil plate 2*a* surface of the winding 2 nearly at the center part of the winding 2 in the vertical direction to be horizontal when the vehicle transformer is mounted on a vehicle. As described using FIG. 5, the interior of the tank 3 is vertically divided into two by the partition member 17, and a first cooling medium channel 18 is formed at the lower side and a second cooling medium channel 19 is formed at the upper side. As is the case of embodiment 1, both of the cooling medium channels 18, 19 are communicated at one end side in the longitudinal direction of the tank 3, and the circulating pump 8 is intermediately provided at the communication part. At the other end side in the longitudinal direction, the cooling medium channels 18, 19 are connected to the outlet part 7*a*, the inlet part 7*b* of the cooling unit 7, respectively.

Figure 6:
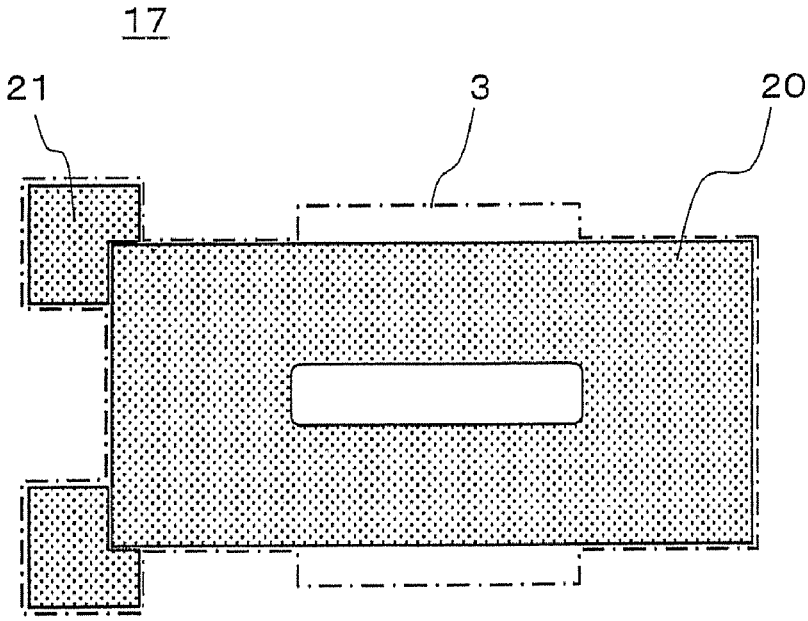
[FIG. 6] A view showing a partition member in FIG. 4.

FIG. 6 shows details of the partition member 17. As shown in the drawing, the partition member 17 includes a rectangular insulating plate 20 conforming the shape of the tank 3 and insulating plates 21 worked to conform the convexly distorted parts such as parts to which the bushings 4, 5 of the tank 3 are attached. As the insulating plate 20, the central one of the plural insulating washers to be inserted between the stacked coil plates 2*a* may be enlarged according the tank inner diameter. The partition member 17 may be formed not only by combining the two members 20, 21 as shown in FIG. 6 but also by further segmentation, for example.

Next, the operation will be described with reference to FIG. 5. With activation of the circulating pump 8, the channel shown by the arrows in the drawing are formed, and the cooling medium 6 cools the lower half of the winding 2 in the process of flowing through the first cooling medium channel 18 from the cooling unit 7 side to the one end side (communication part side) of the tank 3, flows into the second cooling medium channel 19 via the communication part, cools the upper half of the winding 2 and rises in temperature in the process of flowing from the one end side (communication part side) to the cooling unit 7 side. The cooling medium 6 cooled in the cooling unit 7 flows into the first cooling medium channel 18 within the tank 3 again.

In this manner, as is the case of embodiment 1, the cooling medium 6 is circulated in each half of the winding 2 partitioned by the partition member 17, and the content of the transformer is cooled.

As described above, according to embodiment 2, in the same transformer configuration as that of embodiment 1, the partition member is inserted to divide the winding into two in the horizontal direction, and thereby, the equal advantage as that of embodiment 1 can be obtained by the simple partition member.

Embodiment 3

Figure 7:
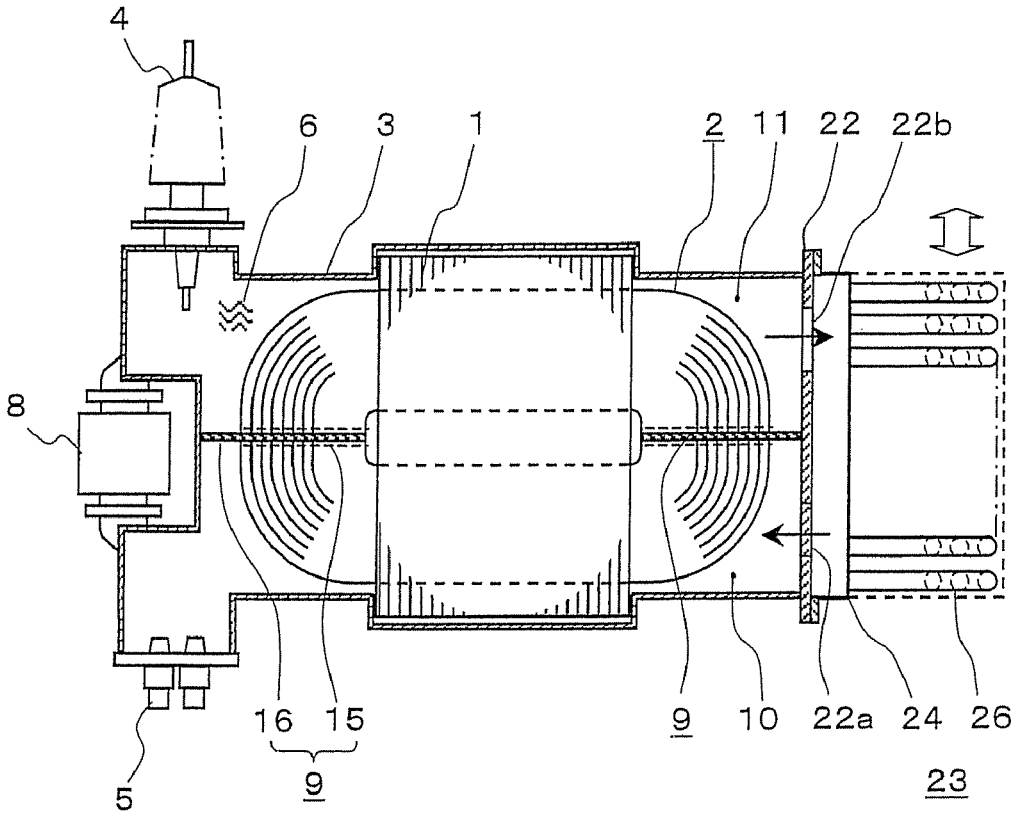
[FIG. 7] A plan sectional view showing an internal structure of a vehicle transformer according to embodiment 3.
Figure 8:
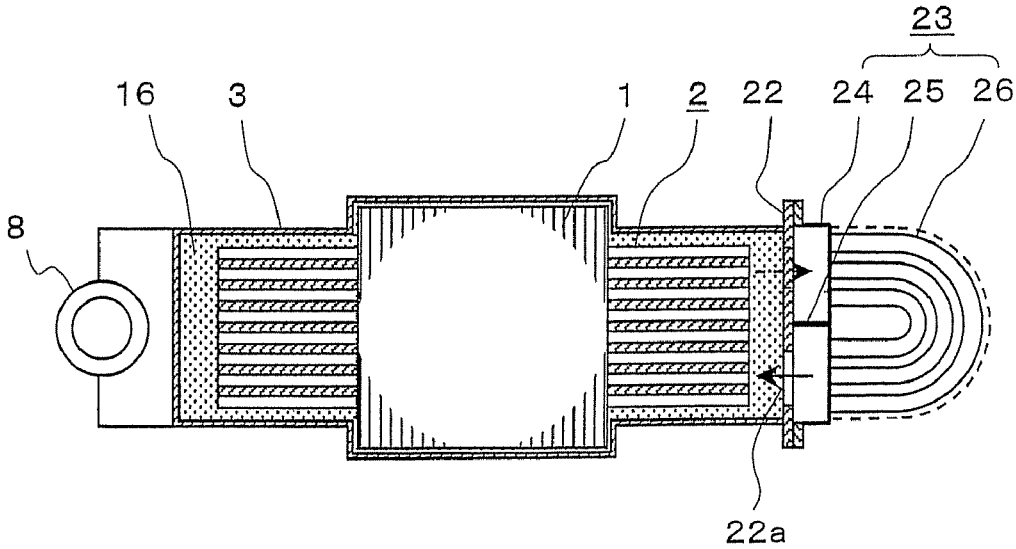
[FIG. 8] a front sectional view showing a section of the center part of FIG. 7.
Figure 9:
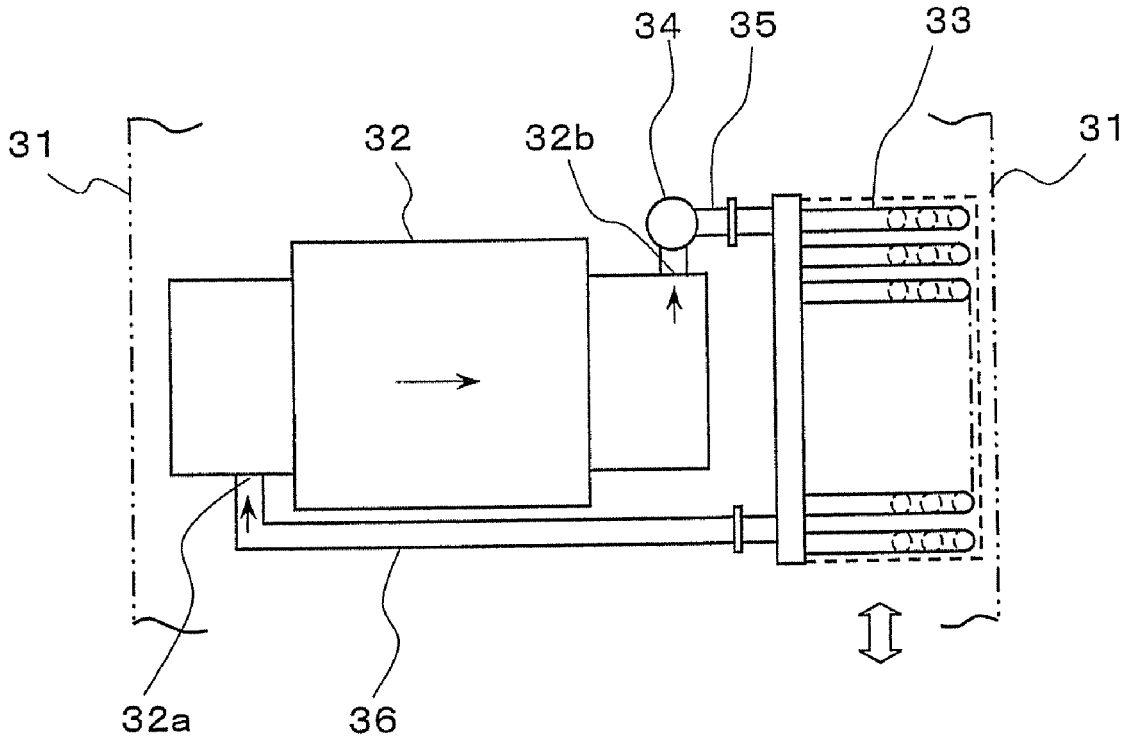
Fig. 9 (PRIOR ART)
[FIG. 9] A plan view showing a configuration of a conventional vehicle transformer.

FIG. 7 is a plan sectional view showing an internal structure of a vehicle transformer according to embodiment 3,and FIG. 8 is a front sectional view showing a section of the center part of FIG. 7.

The same signs are assigned to the equal parts to those in FIG. 1 and FIG. 2 of embodiment 1 and the description thereof will be omitted, and the description will be made centering on the difference.

The difference is in that the attachment structure of the cooling unit to the tank. Further, a cooing unit 23 of embodiment 3 shows a self-cooling type. That is, cooling is performed utilizing traveling wind occurring during traveling of a vehicle (shown by a thick arrow in FIG. 7).

Embodiment 3 is characterized in that the surface of the tank 3 at the side where the inlet and outlet of the cooling medium are provided in embodiment 1 or 2 is also used as an attachment surface to which the cooling unit 23 is directly attached and an attachment flange 22 is provided. In the attachment flange 22, an inlet 22*a* for allowing the cooling medium 6 to flow from the cooling unit 23 into the first cooling medium channel 10 and an outlet 22*b* for sending the cooling medium 6 from the second cooling medium channel 11 into the cooing unit 23 side are formed.

In the drawing, the tank wall surface and the attachment flange integrally formed as one member is shown, however, the tank wall surface and the flange may be separate members and they may be secured by welding or the like.

The attachment side of the cooling unit 23 is a header 24 having a flange around itself, and a partition plate 25 for horizontal partition is provided at the center part within the header, and thereby, the interior of the header 24 is vertically partitioned. As shown in FIG. 8, the partitioned upper and lower chambers are connected by a cooling tube 26 including plural U-shaped pipes.

Since the configuration that the interior of the tank 3 is partitioned into the first cooling medium channel 10 and the second cooling medium channel 11 by the partition member 9 and the cooling medium 6 circulates and cools within the partitioned winding 2 is the same as that of embodiment 1, more detailed description will be omitted.

The insertion direction of the partition member 9 may be the horizontal direction as is the case of embodiment 2.

Further, the cooling unit 23 may not be the self-cooling type in the drawing but may be the air-cooling type with fans as the cooling unit 7 of embodiments 1, 2. Conversely, the self-cooling type cooling unit may be used in place of the air-cooling type cooling unit in embodiment 1 or embodiment 2.

As described above, according to embodiment 3, the cooling unit is directly attached to the side surface of the tank of the transformer main body equal to that of embodiment 1 or embodiment 2, and thereby, in addition to the advantage of embodiment 1 or 2, the connecting tube for connecting the cooling unit and the tank is no longer necessary and further reduction in size and weight of the vehicle transformer can be realized.

It should be understood that various changes and modifications of the invention can be realized by a person skilled in the art without departing from the scope and spirit of the invention, and are not limited to the respective embodiments disclosed in the specification.

The invention claimed is:

1. A vehicle transformer comprising:

a tank;

a cooling unit for cooling a cooling medium filling the tank;

a circulating pump for forcibly circulating the cooling medium through the tank interior;

a core disposed in the tank interior and including a center leg;

a winding disposed in the tank interior and comprising a plurality of coil plates each including a winding wound about an axis around the center leg, the coil plates being spaced apart along said axis by insulating washers which are interposed between adjacent coil plates to define cooling medium paths between the adjacent coil plates; and a partition structure disposed within the tank interior for forming therein first and second cooling medium channels, the partition structure including partition spacers disposed on the insulating washers and extending between adjacent coil plates, wherein a first portion of each cooling medium path is disposed in the first cooling medium channel, and a second portion of each cooling medium path is disposed in the second cooling medium channel, the first and second cooling medium channels communicating with one another through a communication part disposed at a first end side of the tank, the first cooling medium channel arranged to receive cooling medium from the cooling unit through an inlet disposed at a second end side of the tank opposite the first end side, and the second cooling medium channel arranged to discharge cooling medium to the cooling unit through an outlet disposed at the second end side of the tank, wherein cooling medium enters the first cooling medium channel through the inlet and passes through the first portions of the cooling medium paths in a direction transversely of the axis, then travels into the second cooling medium channel via the communication part and passes through the second portions of the cooling medium paths in a direction transversely to the axis before exiting the tank through the outlet.

2. The vehicle transformer according to claim 1, wherein the partition structure is vertically oriented to arrange the first and second cooling medium channels in horizontally side-by-side relationship.

3. The vehicle transformer according to claim 1, wherein the partition structure is horizontally oriented to arrange the first and second cooling medium channels one atop the other.

4. The vehicle transformer according to claim 1, wherein the cooling unit is directly attached to a wall surface at the second end side of the tank.

5. The vehicle transformer according to claim 1, wherein the circulating pump is provided in the communication part.

6. The vehicle transformer according to claim 2, wherein the cooling unit is directly attached to a wall surface at the second end side of the tank.

7. The vehicle transformer according to claim 2, wherein the circulating pump is provided in the communication part.

8. The vehicle transformer according to claim 3, wherein the cooling unit is directly attached to a wall surface at the second end side of the tank.

9. The vehicle transformer according to claim 3, wherein the circulating pump is provided in the communication part.

10. The vehicle transformer according to claim 1, wherein the cooling medium paths are formed by spacers disposed on the insulating washers.

11. The vehicle transformer according to claim 10, wherein the cooling medium paths are non-linear.

* * * * *